United States Patent [19]

Miller et al.

[11] 3,934,870

[45] Jan. 27, 1976

[54] SHEET FEEDING DEVICES

[75] Inventors: Laurence G. Miller, Drybrook; Vernon J. Smith, Tewkesbury, both of England

[73] Assignee: Rank Xerox Ltd., London, England

[22] Filed: Nov. 19, 1973

[21] Appl. No.: 417,022

[30] Foreign Application Priority Data

Dec. 1, 1972 United Kingdom ..... 55724/72

[52] U.S. Cl. ..... 271/164; 271/171

[51] Int. Cl.[2] ..... B65H 1/04

[58] Field of Search ..... 271/171, 162, 164, 145, 271/170, 223

[56] References Cited

UNITED STATES PATENTS

| | | | |
|---|---|---|---|
| 2,905,467 | 9/1959 | Zahradnik | 271/223 |
| 3,061,303 | 10/1962 | Glaser et al. | 271/171 |
| 3,301,551 | 1/1967 | Cassano et al. | 271/170 X |
| 3,570,844 | 3/1971 | Anderson et al. | 271/171 X |
| 3,647,207 | 3/1972 | McPherson | 271/171 X |
| 3,689,064 | 9/1972 | Kuksa | 271/164 |

*Primary Examiner*—Evon C. Blunk
*Assistant Examiner*—Bruce H. Stoner, Jr.
*Attorney, Agent, or Firm*—Bernard A. Chiama; Earl T. Reichert

[57] ABSTRACT

A receptacle for supporting a stack of sheets which are to be fed into a reproduction machine has a support surface and two parallel margin guides which can be moved asymmetrically with respect to the support surface so that sheets of different widths can be placed in the receptacle with the center line of the stack always in alignment with the center line of the feed path through the machine. This is effected by a lug mounted on the receptacle at a position remote from the support surface for movement with the guides in the same direction as, and by the average distance which the guides move relative to the support surface.

3 Claims, 5 Drawing Figures

SHEET FEEDING DEVICES

BACKGROUND OF THE INVENTION

This invention relates to the feeding of sheets seriatim from a stack of sheets on a support surface. Such support surfaces are provided with edge margin guides for engaging the sides of the stack in order to keep the sheets in proper registration. When a support surface is required to accommodate sheets of different widths, the distance between the edge margin guides must be adjustable.

In some arrangements, the edge margin guides are mounted in different sets of holes or slots in the support surface, or blocks of different widths are provided for building out a fixed edge margin guide to the correct position for the edge of the stack. In both these arrangements, the adjustment of the effective surface of the edge margin guide is in descrete steps. British patent specification No. 1284832 discloses edge margin guides which are located by spring loaded balls in discrete steps engaging spaced recesses.

Continuous adjustment of the edge margin guides has also been proposed, but with such continuous adjustment it becomes more difficult to position the edge margin guides accurately symmetrically about the center line of the support surface, and connecting linkages had been proposed for ensuring that any movement of one edge margin guide is accompanied by movement of the other edge margin guide in the opposite direction by the same distance. The alignment of the center line of the sheets in the stack with the center line of the feed path through the machine is required so that the sheets should travel through the system without skewing.

An example of a connecting linkage for a pair of edge margin guides movably mounted on a support surface is disclosed in British patent specification No. 747,396. In the specification, two edge margin guides are supported by pins on a plate below the paper tray, the pins moving in a separate slot for each guide. The guides are linked by means of chains and sprockets so that movement of one edge guide is accompanied by an equal and opposite movement of the other guide, that is the edge guides are always symmetrical about the centre line of the apparatus. This linkage is expensive to manufacture and to tool-up, and it is possible that the movement of the edge guides may become unsynchronised due to wear or bending of the linkage.

BRIEF SUMMARY OF THE INVENTION

According to one aspect of the invention there is provided a receptacle having a support surface for a stack of sheets, and two parallel margin guides which can be relatively moved asymmetrically with respect to said support surface, an arrangement being provided for compensating for the movement of the center of the space between the guides relative to the support surface. This compensating arrangement may comprise a locating lug mounted on the receptacle at a position remote from the support surface for movement with the guides in the same direction as and by the average distance which the guides move relative to the support surface. With this arrangement, the center line of a support surface between the two margin guides will always be a fixed distance from the locating lug, so that if the locating lug is located at a fixed position, the said center line will also be located in a fixed position.

According to another aspect of the invention there is provided a sheet feeding device comprising a frame, a support surface for a stack of sheets movably mounted in the said frame, an edge margin guide fixed to the support surface, a second edge margin guide movable on the support surface relative to the first margin guide, a lug movable relative tc support surface in the same direction as the movable edge margin guide and by half the distance, and a locating device mounted on the frame for locating said lug in a fixed position in the direction of movement of the edge margin guide, so that the line equidistant between the two edge margin guides on the support surface is located in a given position relative to the frame.

BRIEF DESCRIPTION OF THE DRAWINGS

An example of the invention will now be described with reference to the accompanying drawings in which.

DETAILED DESCRIPTION OF THE DRAWINGS

Figure 1:
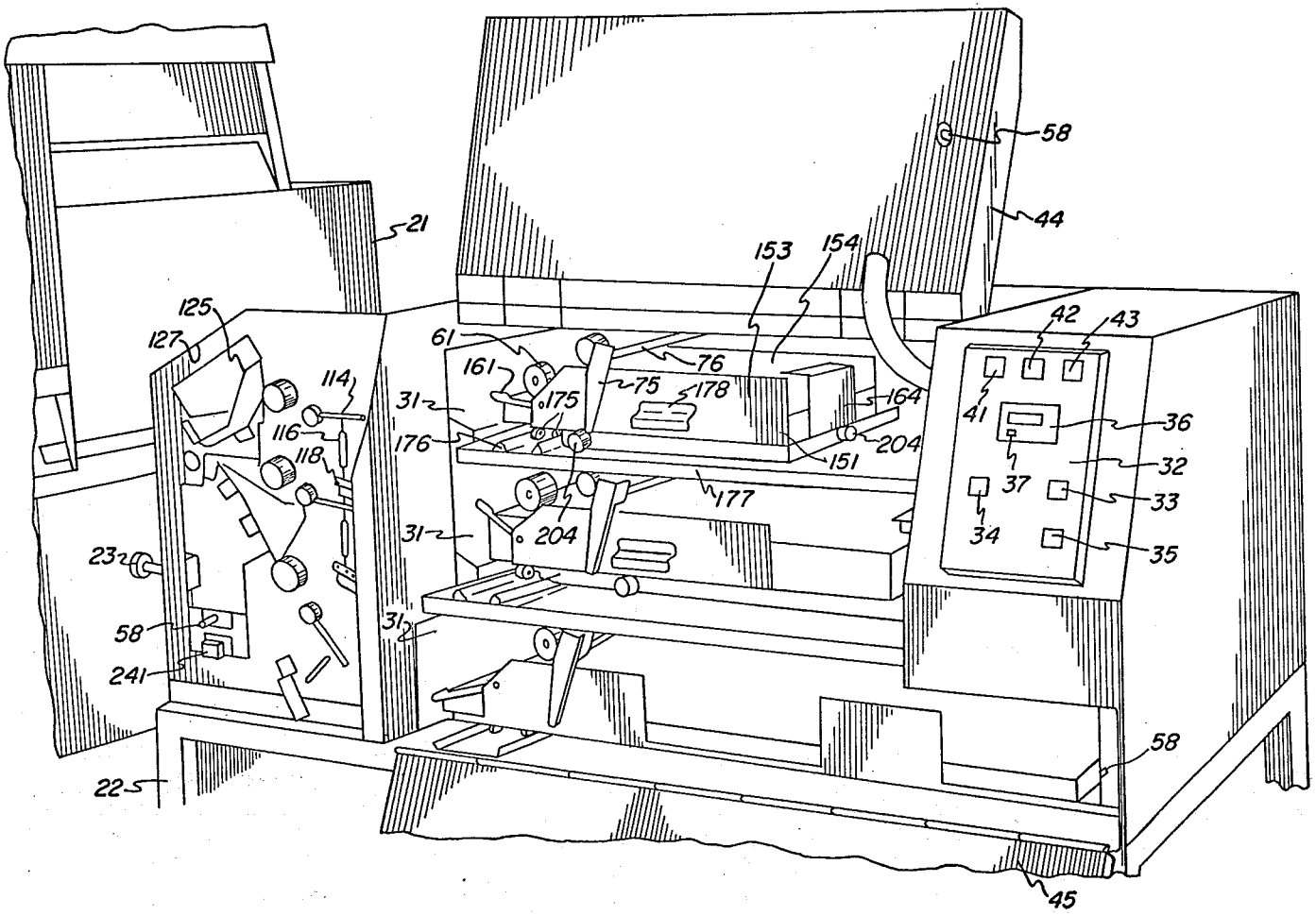
FIG. 1 is a perspective view of sheet feed apparatus with some parts of its cabinet removed and some of its doors opened.

The sheet feeding apparatus shown in the drawings is intended for feeding cut sheets of different sizes into a main copying machine 21, which forms xerographic images of an original on the sheets. The central portion of the apparatus as seen in FIG. 1 contains three compartments 31, supporting paper trays 151 for three sizes of sheet. Inside the top of each paper tray compartment 31, there is provided a pair of feed rolls 61. These rolls normally rest on the top of a stack of sheets supported on a paper tray 151 within a compartment 31, and can be lifted off the stack by rotating the handle 75 to the right as seen in FIG. 1 about shaft 76.

Figure 3:
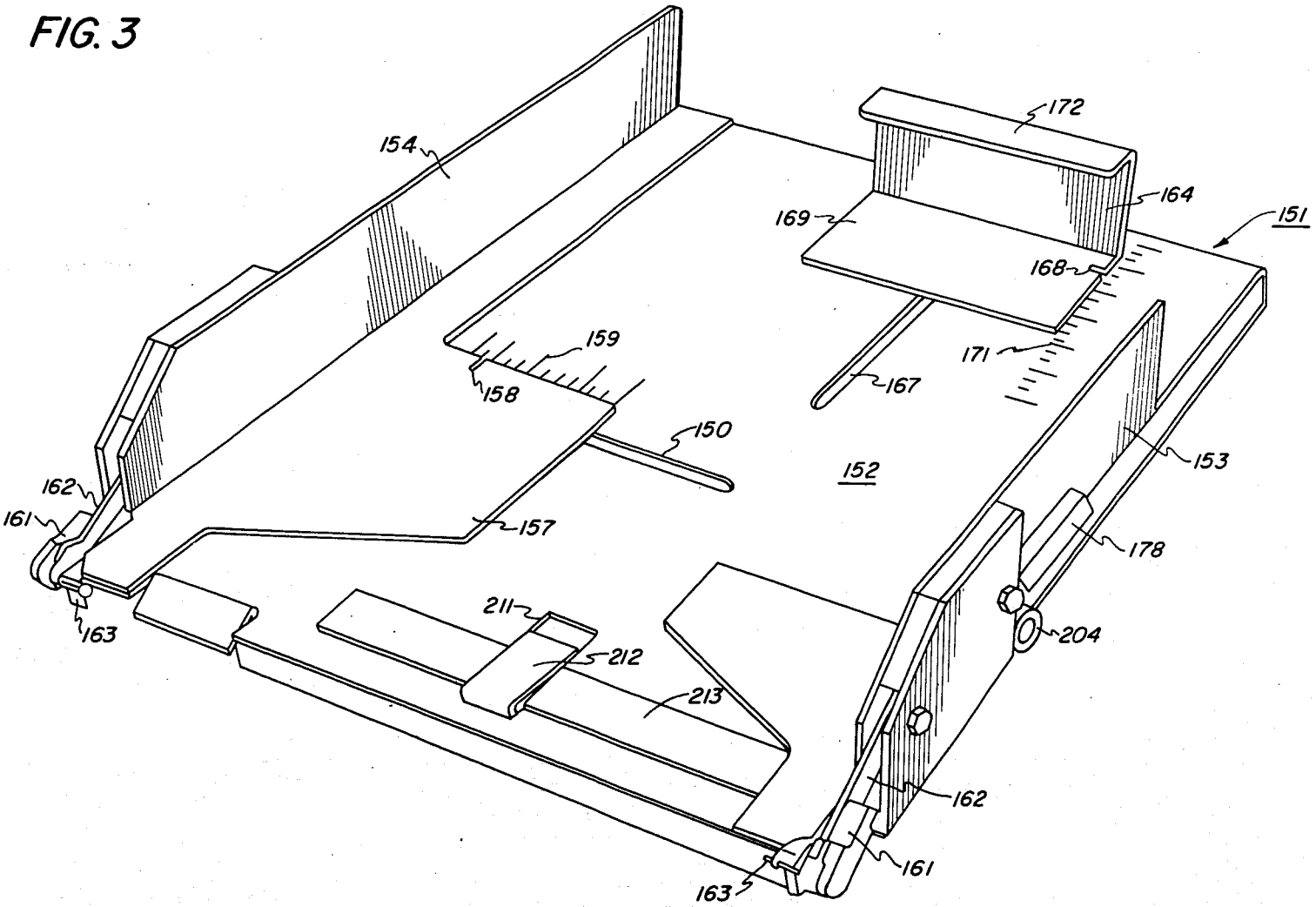
Figure 4:
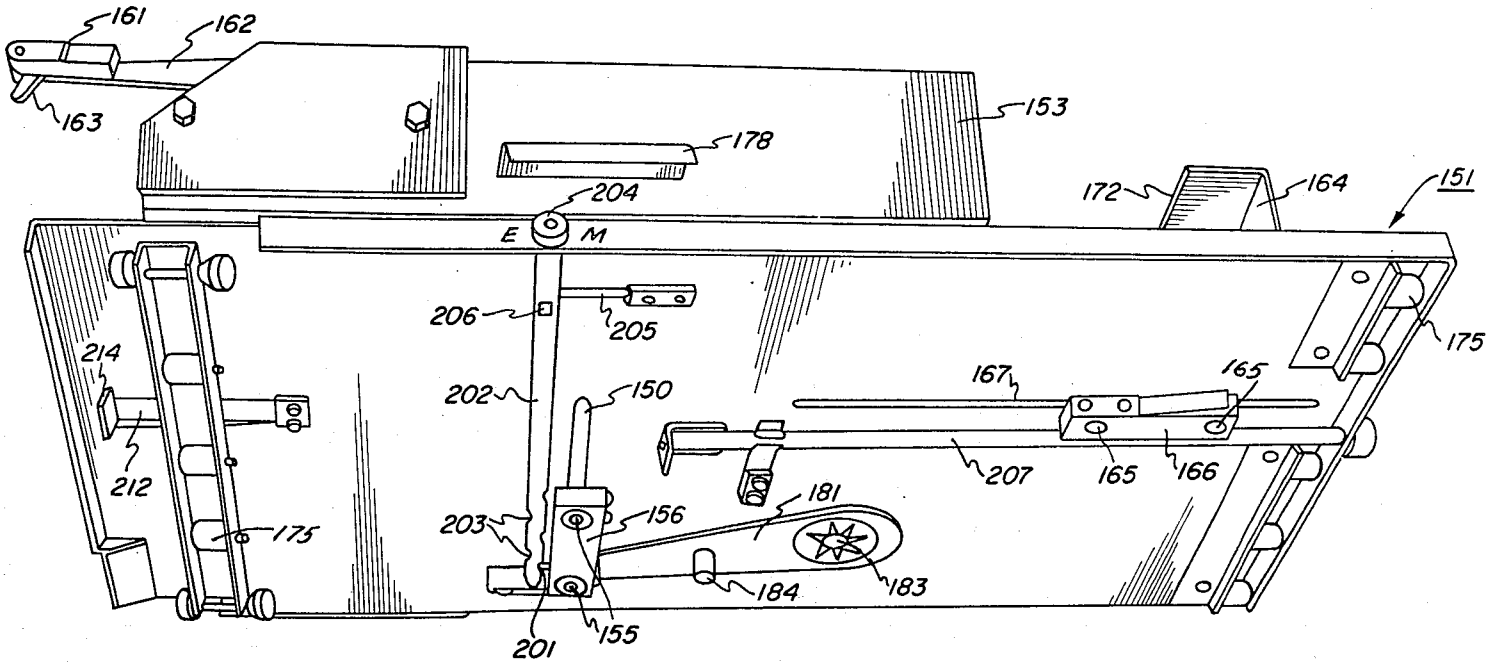

Referring to FIGS. 3 and 4, each paper tray 151 comprises a base plate 152 with a front margin guide 153 which is fixed to the base plate. The rear margin guide 154 is movable relative to the base plate 152, and is mounted on two pins 155 passing through a slot 150 in the base and attached to a block 156 below the base place. The rear edge margin guide 154 is provided with a plate 157 which extends partially over the base, which together with the pins 155 and the block 156 provides a firm mounting for the rear edge margin guide on the base plate. The plate 157 is provided with an index 158 which moves relative to a scale 159 on the base plate 152 to indicate the separation of the rear guide 154 from the front guide 153.

On the underside of the tray, there are two rows of rollers 175, mounted on axes extending parallel to the front and rear edge margin guides 153, 154. The left hand row of rollers co-operate with rails 176 formed on the floor 177 of the compartments 31, and the right hand rollers rest on the floor of the compartments, so that the tray 151 can be rolled into and out of the compartment 31. The direction of movement of the tray is at right angles to the direction of the paper feed. The front margin guide is provided with a handle 178 on the outside for use when moving the tray in the compartment.

Figure 2:
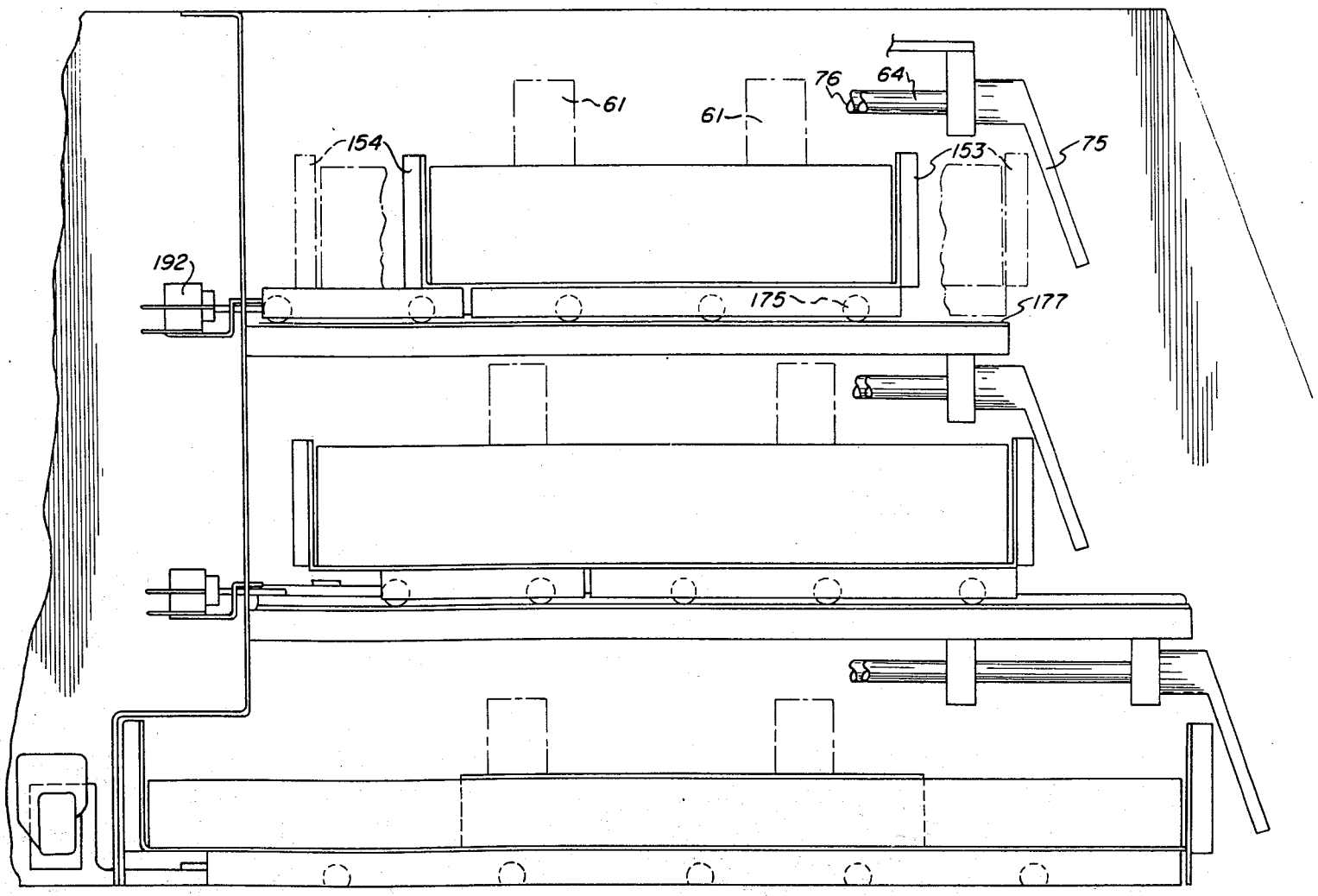
FIG. 2 is a schematic end elevation of part of the apparatus shown on the right hand inside of FIG. 1, FIGS. 3 and 4 are perspective views of a paper tray used in the apparatus illustrated.

Since it is important that the sheets in the tray are fed forward without skewing along the center line of the apparatus illustrated in FIG. 1, the tray 151 should be located such that the centre line of the sheets in the tray are located on a fixed line in the machine, whatever the position of the rear guide 154 of the tray. FIG. 2 shows in the top compartment 31 in full lines the position of the tray for narrow sheets of paper and in chain dotted lines the position of the tray for wider sheets of paper. It will be seen (FIGS. 4 and 5) that the position of the front guide 153 and base 152 of the tray is different for the two widths of paper, and a locating device 179 is provided for automatic location of the tray in its correct position, according to the relative position of the rear side of the tray.

Figure 5:
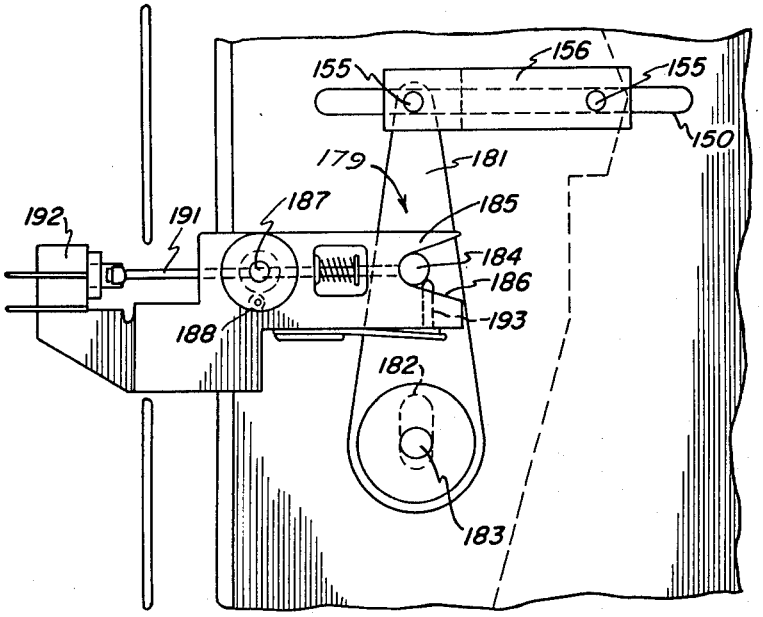
FIG. 5 is an underplan view of a detail of the apparatus.

On the underside of the tray (FIGS. 4 and 5), a link arm 181 is pivoted to the block 156 about one pin 155 at one end, and is provided with a longitudinal slot 182 at the other end through which extends a pivot pin 183 mounted on the underside of the tray. A lug 184 extends downwards from the link at a point equidistant from the mid point of the slot 182 in the arm, and from the pin 155 on the block 156. As the rear guide 154 of the tray is moved by a certain distance, the lug 184 will therefore move by substantially half this distance, so that the lug 184 will remain at a fixed distance from a line equidistant from the front and rear margin guides 153, 154. As can be seen in FIG. 5 the lever 185 is mounted for limited rotation about a pin 187, the rotation being limited by means of a stop pin 188 extending through an enlarged hole in the lever 185. This limited rotation accommodates some sideways movement of the trays 151 in their rails 176.

At the base of the recess 186, there is provided a spring loaded plunger 191 engaging a microswitch 192 connected to the machine logic. At the side of the recess there is provided a spring latch 193 which biases the lug 184, to remain within the recess 186 after entry.

The link arm 181 is pivoted about the pin 183 mounted on the underside of the tray by means of the slot 182, because the distance of the pin 155 about which its upper end is pivoted from the pin 183 varies as the pin 155 is moved along the straight slot 150. This means that the distance moved by the lug 184 will vary slightly from exactly half the distance moved by the guide 154 relative to the tray, but the variation will be of a small order. By locating the lug 184 equidistant from the pin 155 above which the link arm 181 is pivoted and from the mid point of the slot 182, a ratio of the movement of the guide 154 varies on either side of 1:2 during movement of the guide 154 along the slot 150.

The block 156 is provided with a spring loaded lug 201 extending from one side, which is adapted to engage a register bar 202 located on the underside of the paper tray 151. The register bar 202 is generally cylindrical, having two series of recesses 203, extending parallel to the axis of the bar along two opposed sides of the bar. The recesses merge smoothly into the cylindrical surface of the bar in the direction transverse to the axis of the bar. The recesses 203 are located to engage the spring loaded lug 201 of the block 156 at the position corresponding to the separation of the front and rear guides of the tray to accommodate standard size widths. One line of recesses is provided appropriate to English sizes, and the other line appropriate to metric sizes.

The register bar 202 is rotatable by means of a handle 204 on the front of the tray (see FIG. 3). A leaf spring 205 mounted on the under side of the tray engages a short section portion 206 of the register bar 202 in order releasably to retain the bar in any one of four symmetrically spaced positions, two opposed positions corresponding to the alignment of the two lines of recesses with the spring loaded lug 201. Symbols M and E are marked on the tray adjacent the handle, the appropriate one of which will be opposite a marker on the handle 204 when the corresponding series of metric or English size recesses 203 is located in line with the spring loaded plunger 191.

When it is required to adjust the position of the rear side of the tray, the tray is removed from the apparatus by rotating the handle 75 anticlockwise as seen in FIG. 1 about shaft 76. As is fully described in copending application U.S. Ser. No. 417,016 rotation of the handle 75 causes the feed rollers 61 to be lifted from the stack on the paper tray. The paper tray is rolled from the compartment 31 on the rollers 175 (to the right in FIG. 2).

The handle 204 is rotated through 90° so that the spring loaded plunger 201 is ejected from a recess 203 by sliding up the boundary of the recess which merges smoothly into the generally cylindrical surface of the bar 202. The rear guide 154 of the tray is then moved to approximately the newly required position the lug sliding along the cylindrical surface of the bar, after which the register bar 202 is turned so that the symbol on the handle is opposite the M or E on the tray. This rotation of the bar 202 will bring the appropriate set of recesses 203 into line with the spring loaded lug 201. The rear guide 154 is now moved further towards its required position, at which the spring loaded lug 201 will spring into the appropriate recess 203. This arrangement has the advantage that the separation of the front and rear guides 153, 154 of the tray is controlled, and (unless the operator homes in on the wrong recess) the stack of sheets in the tray cannot be left too loosely or too tightly in the tray, either of which conditions would adversely effect the accuracy of feeding of the sheets.

A similar register bar 207 is provided to control the location of the block 166 of the right hand end guide 164. The block 166 is connected to the end guide 164 through a slot 167 via pins 165.

When the tray 151 is returned to the compartment, the left hand rollers 175 engage the rails 176 and the link arm rollers roll on the floor 177 on the compartment 31, and the lug 184 on the underside of the tray 151 engages the locating device 179. When the lug 184 reaches the base of the recess 186, the spring loaded lug 193 will latch the lug 184 in the recess 186, and the lug 184 will depress the plunger 191 to actuate the microswitch 192. This microswitch 192 causes the machine logic to de-actuate an alarm which indicates that the paper tray is not registered, and the machine logic will then allow the apparatus to continue feeding the sheets from the tray provided that there are no other abnormalities in the apparatus which have been sensed by the sensing devices for the machine logic.

What we claim is:

1. A sheet feeding device comprising a frame, means defining a support surface for a stack of sheets, the surface being movably mounted in the frame so that the surface can be moved to either a feeding position for feeding sheets or to a loading position for loading sheets onto the surface, a first edge margin guide fixed to the surface, a second edge margin guide movably mounted on the surface so that the second edge margin guide can be moved in a direction perpendicular to the first edge margin guide while the surface is in the loading position, a lug movably mounted to and beneath the surface, means connected to the second edge margin guide for simultaneously moving the lug half the distance and in the same direction as the second edge margin guide when the latter is moved while the surface is in the loading position, and means mounted on the frame for locating the lug in a fixed position along the direction of movement of the second edge margin guide when the surface is moved to the feeding position so that a line equidistant between the edge margin guides is always located in a given position relative to the frame.

2. A sheet feeding device comprising a frame, a support surface for a stack of sheets, the surface being movably mounted in the frame so that the surface can be moved to either a feeding position for feeding the sheets or to a loading position for loading sheets onto the surface, a first edge margin guide fixed to the surface, a second edge margin guide movably mounted on the surface so that the second edge margin guide can be moved in a direction perpendicular to the first edge margin guide while the surface is in the loading position, a lug, means for simultaneously moving the lug half the distance and in the same direction as the second edge margin guide when the latter is moved while the surface is in the loading position, the means for moving the lug comprising a lever disposed under the surface and pivotally connected at one end to the surface and pivotally connected at the other end to the second edge margin guide, the lug being mounted to the lever approximately equidistant from both the pivotal connections, and means mounted on the frame for locating the lug in a fixed position along the direction of movement of the second edge margin guide when the surface is moved to the feeding position so that a line equidistant between the edge margin guides is always located in a given position relative to the frame.

3. A sheet feeding mechanism as set forth in claim 2, and further including a microswitch, and means for actuating the microswitch when the lug is located in the fixed position by the locating means.

* * * * *